US005836652A

United States Patent [19]

Wexler et al.

[11] Patent Number: 5,836,652

[45] Date of Patent: Nov. 17, 1998

[54] INVALID CHAIR WITH PIVOTAL FOOT REST

[75] Inventors: Michael S. Wexler; Darrel Bonnet, both of Ottawa, Canada

[73] Assignee: VMS Rehab Systems Inc., Ogdensburg, N.Y.

[21] Appl. No.: 805,663

[22] Filed: Feb. 27, 1997

[51] Int. Cl.[6] ..... A47C 7/50

[52] U.S. Cl. ..... 297/423.28; 297/423.26; 297/423.38

[58] Field of Search ..... 297/423.15, 423.25, 297/423.26, 423.28, 423.35, 423.38, 423.4

[56] References Cited

U.S. PATENT DOCUMENTS

| | | | |
|---|---|---|---|
| 202,560 | 4/1878 | Longking | 297/153 X |
| 360,487 | 4/1887 | Stuck | 297/423.25 |
| 409,654 | 8/1889 | Westwood | 297/423.25 |
| 1,947,212 | 2/1934 | Malcolm | 297/423.38 X |
| 2,281,732 | 5/1942 | Uline | 297/423.26 |
| 2,717,027 | 9/1955 | Thatcher | 297/423.38 X |
| 4,634,183 | 1/1987 | Ruiz | 297/423.28 |

*Primary Examiner*—Peter R. Brown
*Attorney, Agent, or Firm*—Martin J. Marcus

[57] ABSTRACT

A chair for invalids and patients is provided herein. Such chair includes front and rear legs and a seat connecting the legs. The seat includes seating portion having a front edge located at a height above the knees of a typical adult and a back rest. Preferably, although not essentially, the legs rise above the seat, and arm rests are secured to the top portions of the legs above the seat with one arm rest on either side of the seat. The chair further includes a foot rest having a pivotal connection by an over-center mechanism at its rear edge to the lower portions of the front legs of the chair. The foot rest is pivotally secured in a particularly-recited manner, so that it is pivotable from a substantially horizontal position to a substantially vertical position. The foot rest, when in its in vertical stowed position lies within the confines of the legs of the chair, and when in its horizontal position extends forwardly of the chair. The foot rest includes an abutment stop of a particularly-recited construction which is situated completely along the rear edge of the foot rest and extending beyond the side edges thereof, the abutment stop being adapted to limit downward pivoting movement of the foot rest by abutment against the rear face of an associated front leg.

14 Claims, 4 Drawing Sheets

INVALID CHAIR WITH PIVOTAL FOOT REST

BACKGROUND OF THE INVENTION (i) Field of the Invention

This invention relates to an invalid chair including means to help an infirm or arthritic patient to rise from the chair.

(ii) Description of the Prior Art

It has been recognized that such chairs should have a foot rest which is adjustable and which can be swung by the chair occupant between an operative position and an out-of-the-way position. In the past, such swinging of the foot rest has generally been in the form of a lever-operated operating mechanism. It is also desirable that the back portion be adjustable.

Heretofore the operating mechanisms provided for the purpose of swinging the foot rest have been complex and costly. Frequently, such mechanisms have not been operable by the occupant of the chair. Further, in many instances when the foot rest was in its retracted position, it was in vertical abutment against the front edge of the seat, so that there was no accessible foot room beneath the chair. Consequently, the occupant was not offered a maximum degree of comfort.

Wheel chairs frequently included adjustable back portions. U.S. Pat. No. 1,710,821 patented Apr. 30, 1929 by A. G. Hackney, provided a wheel chair for the use of invalids in which the back portion may be lowered to a position level with the seat portion, and also where the leg portions may be also adjusted to a position level with the seat portion, thus forming a cot, and in which the back portion may be adjusted in such a manner that it will remain in the adjusted position until the position is changed by the adjusting means being manipulated. Such wheel chair was provided by the combination of a main frame, with downwardly-projecting members secured to the forward portion of the main frame. An axle was secured in the downwardly-projecting members with wheels being secured on the ends of the axle. A leg portion was pivotally-secured to the forward portion of the main frame and was adapted to swing downwardly in front of the axle. A back portion was pivotally-connected to the rearward portion of the main frame. Means were associated with the back portion and the main frame to permit angular adjustment of the back portion with relation to the main frame. A wheel was provided for supporting the rear end of the main frame. The back portion and leg portion were adapted to be swung into the same horizontal plane as the main frame.

Exercising devices also included mechanisms for controlling and operating a foot rest-like platform. Thus, U.S. Pat. No. 3,000,632 patented Sep. 19, 1961 by A. A. Fuchs, provided such an exercise device which was incorporated into a chair structure. Such exercise device included a seat with a horizontally-disposed transverse rod mounted adjacent the front edge of the seat for rotation about its longitudinal axis. A laterally-extending arm was rigid with the rod and included a weight mounted therein. A support member extended laterally outwardly from the rod and was slidably and pivotally-mounted on the rod. Prop means were attached to and supported the outer end of the support member. A foot pedal was hingedly attached to the outer end of the support member for pivotal movement about an axis which was generally parallel to the longitudinal axis of the rod. Means on the foot pedal secured a person's foot thereto. A flexible member was connected to the foot pedal in spaced relation to the pivotal connection between the pedal and the support member.

U.S. Pat. No. 3,087,757 patented Apr. 30, 1963 by H. Fidel, provided a chair having a foot rest that was hinged along the front edge of the seat of the chair so as to be moved between a forwardly extending position in substantial alignment with the chair seat and a retracted position. The foot rest had a single operating mechanism for moving it from an extended to a retracted position, and vice versa. The chair included a frame, a seat having a recess in the underside thereof mounted to the frame, a back, and a foot rest having one edge thereof pivoted to the seat along the front edge thereof. A releasable spring on the underside of the foot rest was adapted to cooperate with spring-engaging means on the underside portion of the seat for retaining the foot rest in retracted position within the recess and in abutting parallel relation with the underside of the seat. A rotatable shaft extended transversely of the chair and was mounted in the seat. An operating handle was secured to one end of the rotatable shaft and projected therefrom with the free end thereof accessible from the seat. A toggle assembly operatively connected the rotatable shaft with the foot rest. In operation, the foot rest was adapted to be released from its extended position and thus to be retracted by rotation of the rotatable shaft, to draw the foot rest into the recess to abut in parallel relation against the underside of the seat.

Some desks also included a chair, a desk and a foot rest. Thus, U.S. Pat. No. 1,236,517 patented Aug. 14, 1917 by G. W. Wemple et al, provided a chair comprising four legs and a top secured thereto at adult sitting height above the floor. One of the legs extended above the top. A desk was slidably-mounted on the leg for adjustment relative to the chair top. A foot-rest was mounted on two of the legs for adjustment relative to the chair top. A seat was slidably-mounted in the chair top and was adapted to be moved toward and from the desk. A chair back of adult size was rigidly secured to the seat. A folding seat portion was attached to the front end of the seat for foreshortening the seat from front to back as the seat was slid upon the chair top. An auxiliary back rest was slidably-mounted on the back for vertical movement thereon.

In the realm of invalid chairs, U.S. Pat. No. 4,358,156 patented Nov. 2, 1982 by H. M. Shiff, provided a foot rest and actuator for chairs for patients and invalids in which no power-operated parts were used. The seat for the chair was elevated and the foot rest was adjustable and could be swung by the occupant to useful or out-of-the-way position. In this way, it was alleged that the patient or arthritic person may be seated with the least difficulty and may more easily get out of the chair with the least aid and with the least difficulty.

That patented chair included a front which was provided with a padded seat in a fixed position with relation to its supporting floor. This seat was elevated with respect to a normal chair so that the arthritic person or invalid may simply lean back on it and be seated with the least trouble. The forward edge of the chair seat was of such a height that it would strike an adult, of normal height, well above the knees. A pivoted foot rest was provided which could be placed in an out-of-the-way position, when it was not in use, and where it did not interfere with the person standing in front of the chair preparatory to being seated therein or to rising from the chair. The foot rest could be pivoted out and was vertically adjustable for the purpose of best supporting the feet of the occupant of the chair. The foot rest was solidly supported at four corners, and to provide a safety feature as the chair will not pivot over frontwards if the patient stands on the foot rest. In order to assist the patient in getting in and out of the chair, a manually-operable lever and link was provided, which was selectively-positioned at either side of the chair, for the patient to operate to pivot the foot rest down to a useful substantially horizontal position, or to pivot it back within the confines of the chair where it is out-of-the-way and did not interfere with the patient getting into or out of the chair.

SUMMARY OF THE INVENTION (i) Aims of the Invention

Nevertheless, all the above-described devices are rather complex and are apt to malfunction. One object of this invention is to provide a chair with a movable foot rest, which when in retracted position, folds beneath the chair seat and abuts in parallel relationship against the underside of the chair seat to form the bottom thereof so as to provide ample free foot room beneath the chair and thereby to maximize the comfort of the occupant, and safety of the caregiver as required.

Another object of this invention is to provide a chair with a retractable foot rest and an adjustable back, the foot rest and the back each being separately and independently adjustable by the occupant of the chair.

Other objects of the invention include the provision of such an invalid chair: which enables correct skeletal alignment reducing joint stress; which helps to eliminate forward trunk lean and to maintain proper hip and knee flexion; which provides added safety and stress-free mobility; which increases independence and patient self-reliance; which fits the occupant's size in order for a patient to sit comfortably and correctly; which is easy to get into and out of; which is of the right height, depth and firmness to enable a patient to sit correctly; which allows the full length of the thighs of the patient to rest comfortably on the seat of the chair; and which has a back that gives firm support so that the body of the patient maintains the proper sitting position.

(ii) Statements of Invention

The present invention provides an improvement in a chair for invalids and patients including front and rear legs, a seat connecting the legs, the seat including a seating portion, having a front edge located at a height above the knees of a typical adult, and a back rest, and a foot rest, which is pivotable from a substantially horizontal active position to a substantially vertical stowed position, the foot rest, in its vertical position, lying stowed completely within the confines of the legs of the chair, and in its horizontal active position extending forwardly of the chair. The improved foot rest includes a generally-rectangular foot rest member which extends between the front legs, the foot rest member including a front edge, a rear edge and two side edges which extend between the front edge and the rear edge. An abutment stop is secured directly to the rear edge of the foot rest member, and coincides with, and lies along, the rear edge. It includes two lateral extensions, one of which extends beyond one side edge, the other of which extends beyond the other side edge. Furthermore the abutment stop extends perpendicularly upwardly from the foot rest member. The extensions of the abutment stop are adapted to abut against an associated rear face of the front legs, thereby to limit downward pivoting movements of the foot rest member. The foot rest member includes two brackets, one of which is affixed to the underface of the foot rest member adjacent to one side edge at the rear edge, the other of which is affixed to the underface of the foot rest member adjacent to the other side edge at the rear edge. Pin means are located forwardly of the rear edge of the foot rest member, and these pin means connect each bracket with an associated front leg. In this manner, the foot rest member is secured to the chair in a cantilevered manner to provide an automatic stop of the upward pivoting to the vertical stowed position, and to permit the pivoting between the positively-stopped horizontal active position and the automatically-stopped stowed position.

The present invention also provides a foot rest conversion kit for a chair for invalids and patients which includes front and rear legs, a seat connecting the legs, the seat including a seating portion having a front edge located at a height above the knees of a typical adult, and a back rest and a foot rest, the improvement wherein the foot rest comprises a relatively narrow platform which is wider at its lateral edges than at its central area and also a front edge, a rear edge and two side edges which extend between the front edge and the rear edge. An abutment stop is secured directly to the rear edge of the foot rest member. It coincides with, and lies along, the rear edge and includes two lateral extensions, one of which extends beyond one side edge, the other of which extends beyond the other side edge. It further extends perpendicularly upwardly from the foot rest member. The extensions of the abutment stop are adapted to abut against an associated rear face of the front legs, thereby to limit downward pivoting movements of the foot rest. The foot rest member includes two brackets, one of which is affixed to the underface of the foot rest member adjacent to one side edge at the rear edge, the other of which is affixed to the underface of the foot rest member adjacent to the other side edge at the rear edge. To secure the foot rest to the chair, pins are provided which are slidingly-located in associated one of the two brackets, the pins being spring-loaded and retractable, the pins being selectively placeable in selected cooperating wells provided as a series of vertically-spaced-apart wells in the front legs of the chair for vertically-positioning the foot rest at a desired elevation. In this way the foot rest is pivotally-secured to pivot from a substantially horizontal active position to a substantially vertical stowed position, the foot rest, in its vertical stowed position lying within the confines of the legs of the chair, and in its horizontal position extending forwardly of the chair. In this way, the foot rest member is secured to the chair in a cantilevered manner to provide an automatic stop of the upward pivoting to the vertical stowed position, and to permit the pivoting between the positively-stopped horizontal active position and the automatically-stopped stowed position.

(iii) Other Features of the Invention

By one feature of the improvement in the invalid chair, the abutment stops comprise a bar secured to the rear edge of the foot rest, the bar extending beyond the side lateral edges thereof.

By another feature of the improvement in the invalid chair, the foot rest is narrower than the length of the foot of a typical patient using the chair, and has a central portion of even more narrow width; e.g., the width of the foot rest at the lateral edges thereof is about 6" to about 8" and wherein the width of the foot rest at the central area is correspondingly about 5" to about 7". By a variation thereof the height of the seat is about 23" to about 25".

By another feature of the improvement in the invalid chair, the over-centre pivotal mechanism comprises pins which are slidingly-located in associated brackets which are secured to a lower face of the foot rest at the lateral edges of the foot rest close to the rear edge of the foot rest, the pins being spring-loaded and retractable; e.g., where the brackets are disposed abutting the rear edge of the foot rest; especially where the pins are selectively placeable in selected cooperating wells provided as a series of vertically-spaced-apart wells in the front legs for vertically-positioning the foot rest at a desired elevation.

By another feature of this embodiment of the invention, the chair includes a wheel secured in a free-wheeling manner in a bracket which is, in turn, secured to the base of each of the legs, thereby to provide a wheeled patient transporter; e.g., where the wheel is provided with a mechanically-actuatable brake.

By a feature thereof, the chair includes a push handle at the rear face of the adjustable back.

By a feature of the foot rest conversion kit embodiment of this invention, an upper face of the foot rest is covered with a non-skid rubber or plastic mat.

By another feature of the foot rest conversion kit embodiment of this invention, the foot rest is narrower at its two lateral areas than the length of the foot of a typical patient using the chair, and has a central area which is even more narrow; e.g., where the width of the foot rest at its lateral areas is about 6" to about 8" and wherein the width of the foot rest at its central area is correspondingly about 5" to about 7".

By yet another feature of the foot rest conversion kit embodiment of this invention, the abutment stops comprises a bar secured to the rear edge of the foot rest and extends beyond the side lateral edges thereof.

BRIEF DESCRIPTION OF THE DRAWINGS

In the accompanying drawings.

Figure 1:
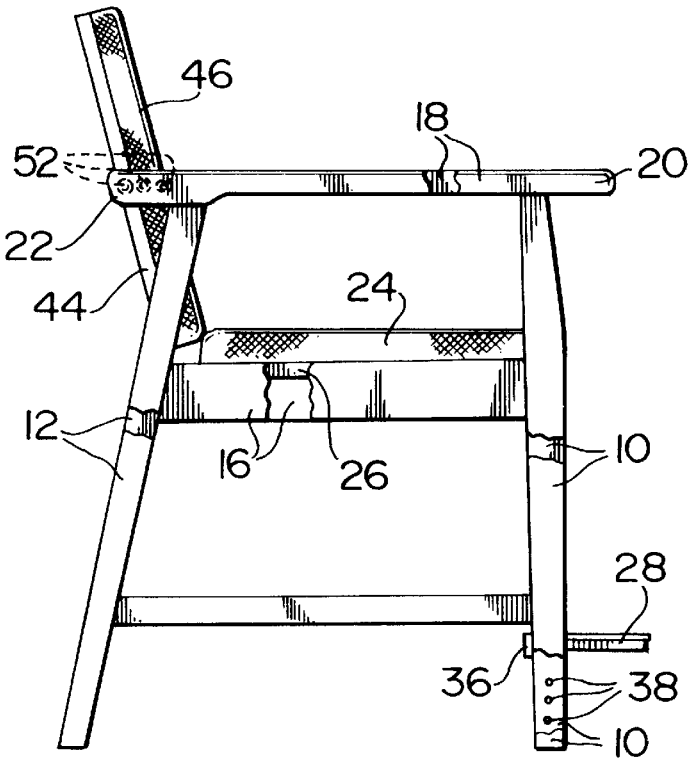
FIG. 1 is a view in side elevation with parts broken away illustrating the foot rest feature of one embodiment of the chair of the invention.
Figure 2:
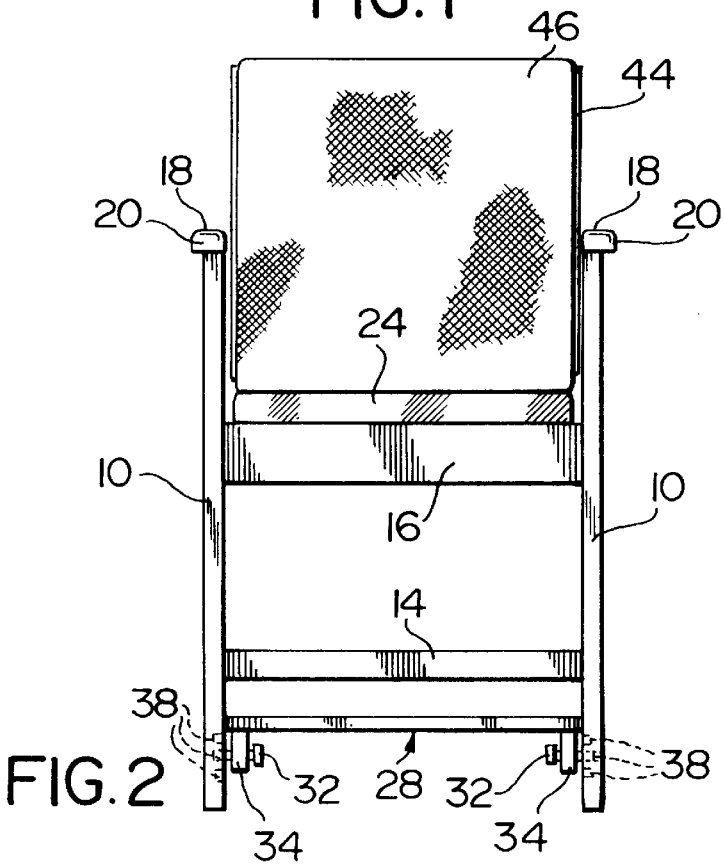
FIG. 2 is front view of the foot rest feature of one embodiment of the chair of the invention.

DESCRIPTION OF PREFERRED EMBODIMENTS (ii) Description of FIGS. 1 & 2

As seen in FIGS. 1 and 2, the chair has two front legs 10 and two rear legs 12, separated by cross-pieces 14, and 16. The legs extend upwardly and are slightly slanted toward each other. At their top ends may optionally be joined by arm rests 18. If the arm rests are provided, these arm rests 18 preferably extend forwardly of front legs 10, as at 20, and rearwardly of rear legs 12, as at 22. A pad 24 is preferably provided on the seat 26 which is shown to be extending front to rear and side to side of the chair. The seat 26 is at an elevation so that it will coincide with an adult patient of usual height well above the knees in the region of the upper portions of the thighs. This height is generally within the range of about 23 to about 25".

The back rest is provided with a frame 44. This frame may have a pad 46 thereon and it is provided with adjusting means, e.g., holes 52 for the selective reception of pins, (not shown), for a pivoted adjustment. At the lower end, the frame 44 may be provided with a pivot pin (not shown).

A foot rest generally indicated at 28 is pivotally-mounted by an over-centre mechanism as by a pair of pins 32. These pins are slidingly located in brackets 34 mounted below the foot rest 25. The pins 32 are spring-loaded and are retractable and placeable in a selected cooperative pair of a series of vertically-spaced-apart wells 38 in the front legs 10 for vertically-positioning the foot rest 28 at a desired elevation. The foot rest 28 is narrow (i.e., about 6" wide at its lateral edges) and includes a central area of even less width (i.e., about 5" wide). A transverse bar 36 extends across the rear of the foot rest 28 and provides a pair of lateral extensions operating as abutment stops to limit the downward pivotal movement of the foot rest. Such abutment stops obviate the need for any support to support the cantilevered forward region of the foot rest 28.

Figure 3:
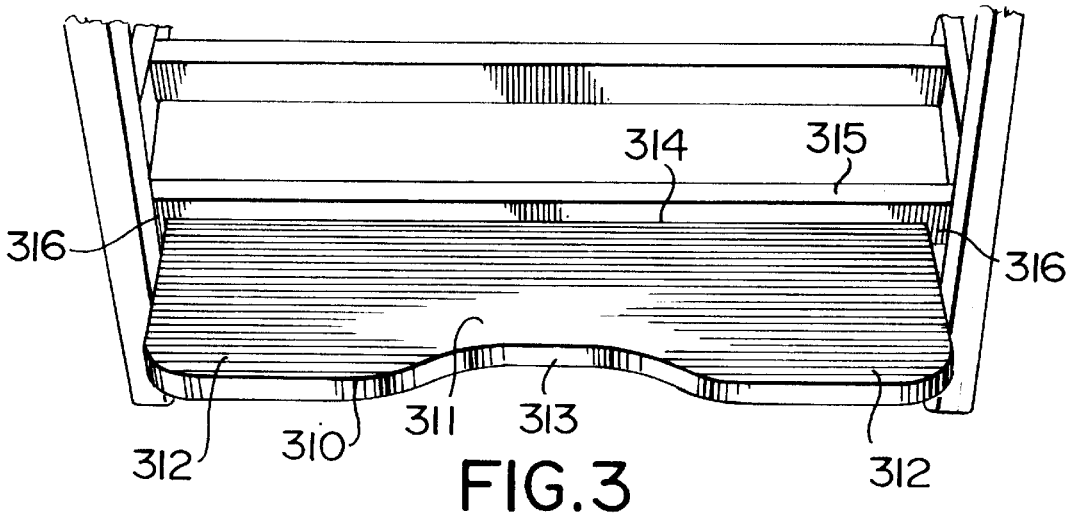
FIG. 3 is a close-up front view of the foot rest feature of one embodiment of the chair of this invention, in its operative orientation.
Figure 4:
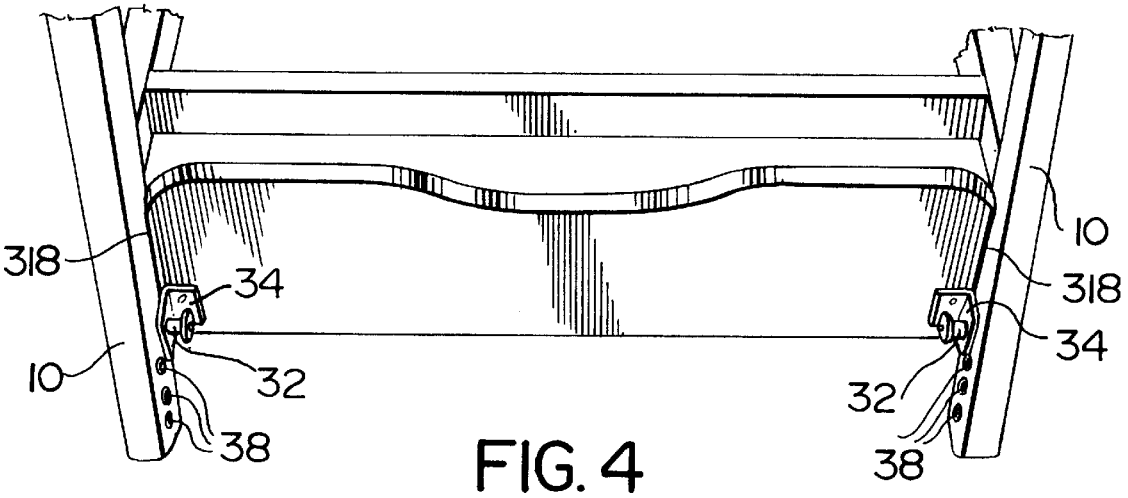
FIG. 4 is a close-up front view of the foot rest feature of one embodiment of the chair of this invention, in its stowed orientation.
Figure 5:
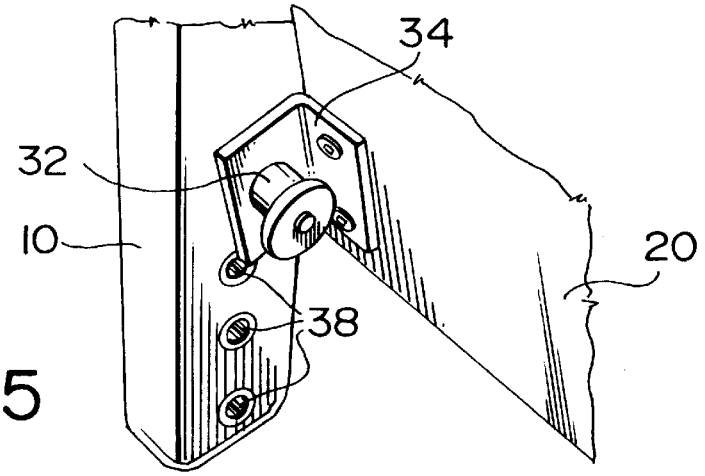
FIG. 5 is a close-up view of the over centre pivotal attachment of the foot rest feature to the leg embodiment of the chair of this invention.
Figure 6:
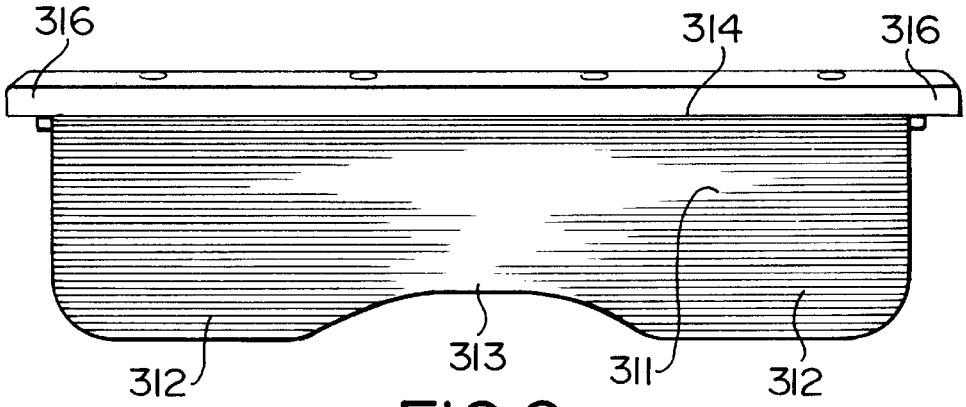
FIG. 6 is a top plan view of the foot rest conversion kit feature of one embodiment of the chair of this invention.
Figure 7:
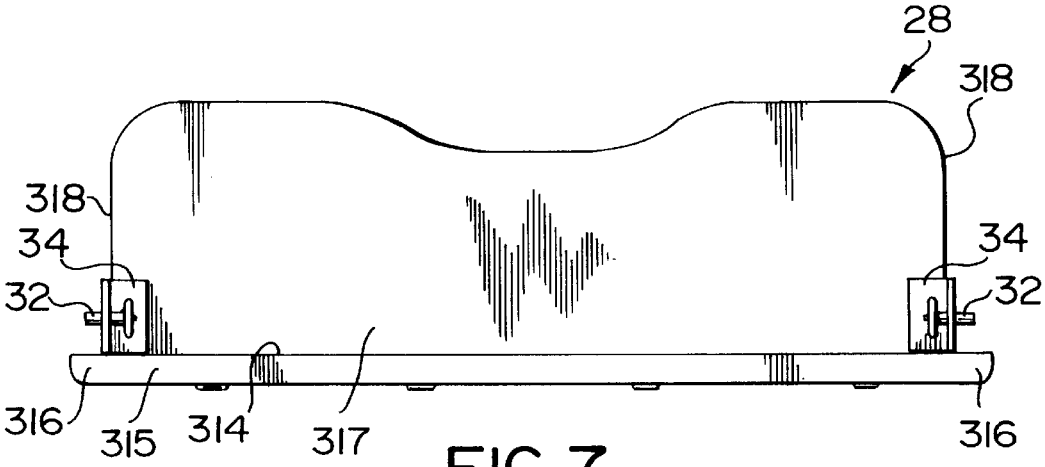
FIG. 7 is a bottom plan view of the foot rest conversion kit feature of one embodiment of the chair of this invention.

(ii) Description of FIGS. 3 & 5

Referring to FIGS. 3 and 5, the foot rest 28 includes an upper face 310, which is covered by a protective, high friction, non-skid rubber or plastic mat 311. The front edge thereof includes two lateral areas 312 of a selected width and a central curved area 313 of a lesser width. Secured to the rear face 314 of the foot rest 28 is a transverse bar 315, having two lateral extensions 316. As seen in FIG. 3 these lateral extensions 316 abut the rear face of the legs 10 when the foot rest 28 is in its operative position.

(iii) Description of FIGS. 4, 5, 6 & 7

Referring to FIGS. 4, 5, 6, and 7, the foot rest 28 also includes a lower face 317. Secured to the lower face 317 adjacent the rear edge 314 and at each lateral edge 318 thereof is a bracket 34 which holds a spring-loaded pin 32. Also seen in FIG. 5 are the plurality of longitudinally-spaced-apart wells 38 in leg 10 within which the pins 32 are adapted to fit.

Figure 8:
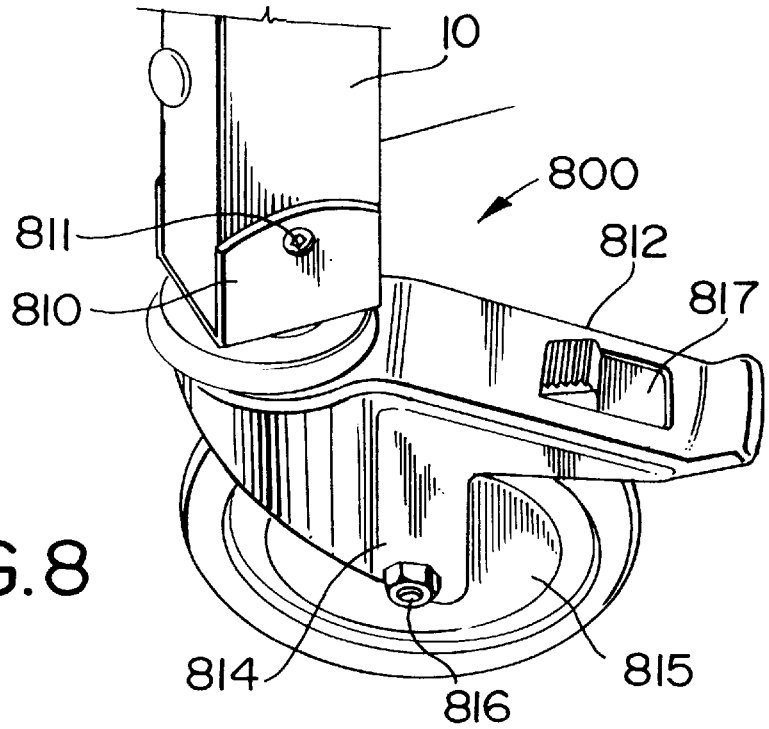
FIG. 8 is one view of a leg of another embodiment of the chair of this invention to provide a wheeled patient transporter.
Figure 9:
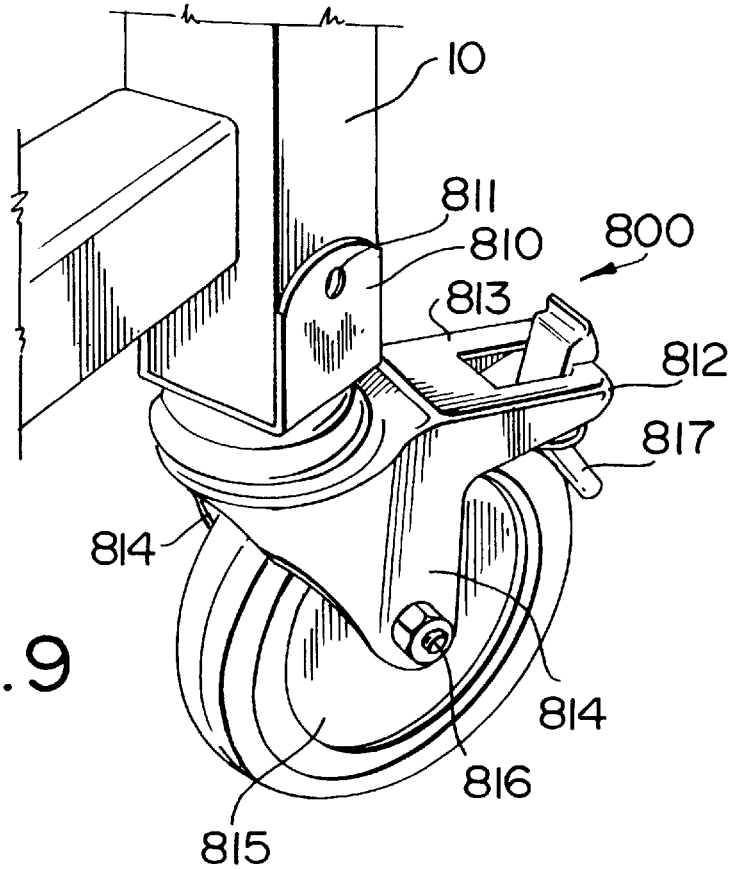
FIG. 9 is another view of a leg of the embodiment of the chair of FIG. 8 of this invention to provide a wheeled patient transporter.

(iv) Description of FIGS. 8 & 9

FIGS. 8 and 9 shows how the embodiment of the invalid chair of FIGS. 1 to 7 can be converted to a patient transporter device. This is accomplished by the securement of a wheeled unit 800 to the base of the legs 10. The wheeled unit 800 includes a rectangular U-frame 810 which is secured to the base of the leg 10, e.g., by screws 811. The frame 810 supports a chassis 812 which is pivotally-secured from U-frame 810 by a pin (not seen) in an essentially frictionless manner, by, e.g., a conventional ball bearing construction. Chassis 812 includes an upper face 813 and a pair of spaced-apart side plates 814. A wheel 815 is secured in a free wheeling fashion between side plates 814 by means of axle 816. A brake construction 817 is provided, if desired, to prevent the wheel from rotating.

OPERATION OF PREFERRED EMBODIMENT

The function of the foot rest of this invention is as follows: When the foot rest is housed on its stowed position, the patient can more easily get into and out of the chair. Once seated, the patient may pivot the foot rest with a foot to its operative position. If the patient cannot perform this simple action, the caregiver may do this. By reversing this action, the patient, or caregiver may stow the foot rest out of the way.

The foot rest is adapted to be pivoted inwardly with respect to the chair, coming to rest automatically due to the over-centre pivotal mounting, in which position it is stowed completely out of the way and the patient may stand in front of the chair facing away from the same.

This chair may also be used for post operative care of post surgical total hips and total knee patients, and it has proved to be excellent with respect to maintenance of body position and extremity alignment. The design allows for ease of entry and exit for patients with functional impairment and provides additional safety benefits when transfer activities are attempted. The chair has a three-position back support. The pivotally-retractable foot rest and can be pivoted between the operative and stowed, inoperative positions easily and with little effort.

DESIRABLE FEATURES PROVIDED BY THE INVENTION

There are many desirable features of the chair of this invention. Among them are the following:

There are two higher-than-normal seating heights of about 23" and about 25" which help to protect joints, conserve energy, and allows safe, easy entry and exit during transfer. The about 19" or about 17" depth of the seat allows for full seat to support thighs. The adjustable features include two height and depth adjustments and extra firm cushions. A wide seat enables patients to maintain slight abduction of their legs and provides added safety to help prevent dislocation following hip surgery. When the chair includes the arm rests, such extended arm rests provide added safety while transferring from canes, crutches or walkers. The A-frame design and construction provides added stability and safety. There are no motorized parts or artificial means to assist patients, thereby encouraging the patient to use the patients' own muscle power.

The three adjustable back positions maintain correct alignment. The structural features allows the patient to maintain comfort and proper skeletal position. The chair includes a slanted seat that can be adjusted to reduce hip flexion from under about 90 degrees to about 60 degrees. The slant adjustments help pressures on the lumbosacral area.

When the chair includes wheels, the rear-raised wheels eliminate damage when transporting the unoccupied chair, therefore increasing the life of the chair. The special multi-function handle makes it easy to push and manoeuvre. Four swivel ball bearing wheels allow easy movement. Each wheel has its own brake to lock and swivel simultaneously.

The chair of embodiments of this invention reduces the overall range of motion and eases transfers from sitting to walking, to bed, cane, or crutches. This in turn enables the patient to have less reliance on hospital staff and family members. Nurses and attendants also benefit by spending less valuable time lifting and moving patients and more time caring for their patients' health. Increased mobility and diminished pain encourage a brighter outlook with personal independence and self-reliance, thus advancing the patient's psychological well-being and speeding their physical rehabilitation. The elevated seat design of the chair of this embodiment of this invention reduces muscle exertion and energy expenditures required to enter and exit the chair. The adjustable back, seat and foot rest help alleviate joint stress by promoting proper skeletal alignment and hip and knee flexion. The non-motorized system in the chair of this embodiment of invention aides prevention of muscular atrophy by encouraging active patient rehabilitation. Unlike motorized lift chairs which force patients to a standing position, the chair of this embodiment of this invention allows this delicate, hazardous and sometimes disorienting action to progress according to the patient's capability. The low centre of gravity frame construction of the chair of this invention adds to the patient's stability while adjusting to the change from a sitting to a standing position.

The chair of embodiments of this invention provides a safe and effective therapeutic device to help the proper post-operative management to patients who have undergone total hip or knee joint replacement surgery, therefore, reducing potential damage to corrective procedures. The chair of embodiments of this invention also assists in reducing back injuries to caregivers and other personnel caused by lifting patients in and out of chairs. By the use of the chair of embodiments of this invention, less nursing assistance is required when the patient enters or exits the seat. The chair of embodiments of this invention provides the proper post-operative care for hip/knee joint replacements. It is also beneficial for patients who suffer from such disabilities as arthritis, geriatrics, stroke, MS, Parkinson's disease, osteoporosis, polyomitis-itis, back surgery and amputees.

The following are additional advantages which accrue from the beneficial effects that the chair of this embodiment of invention achieves: namely, it alleviates muscular stress on hips and knees; it provides correct skeletal alignment; it reduces muscular atrophy; it increases patient independence; it requires less staff intervention; it promotes speedier recovery from surgery; it reduces possibility of damage to corrective actions; it decreases chances of mishaps and accidental falling; it promotes more physical activity from patient; it reduces energy requirements; it and eliminates forward trunk lean.

It is to be observed that, correctly used, a patient should always use the foot platform when sitting in the chair. Examples of incorrect use include where extremely tall patients may close the platform and/or when institutions may lack proper maintenance to support routine repairs. Nevertheless, correct posture in a high seater should require the patient to place his/her feet on the footrest. In fact, most persons of normal height would not be able comfortably to rest their feet on the floor.

It is also to be emphasized that the chair of aspects of this invention features a 3-position back. Most importantly, this feature assists in providing a patient with the level of flexion prescribed by attending professionals. Some caregivers argue for 90 degree angle; others want more like about 60 degrees. Perfect sitting posture may call for erect positioning, feet flat on a surface. The chair of embodiments of the present invention has a back which gives firm support so that the body of the patient maintains the proper sitting position.

CONCLUSION

From the foregoing description, one skilled in the art can easily ascertain the essential characteristics of this invention, and without departing from the spirit and scope thereof, can make various changes and modifications of the invention to adapt it to various usages and conditions. Consequently, such changes and modifications are properly, equitably, and "intended" to be, within the full range of equivalence of the following claims.

What we claim is:

1. In a chair for invalids and patients include front and rear legs, including a seat connecting the legs, said seat including seating portion having a front edge located at a height above the knees of a typical adult, and a back rest and a foot rest, said foot rest being pivotable from a substantially-horizontal active position to a substantially-vertical stowed position, said foot rest, in its vertical stowed position lying within the confines of said legs of said chair, and in its horizontal active position extending forwardly of said chair, the improved foot rest comprising: a generally-rectangular foot rest member which extends between said front legs, said foot rest member including a front edge, a rear edge and two side edges which extend between said front edge and said rear edge, an abutment stop which is secured directly to the rear edge of said foot rest member, and which coincides with, and lies along, said rear edge and includes two lateral extensions, one of which extends beyond one side edge at said rear edge, the other of which extends beyond the other side edge, said abutment stop extending perpendicularly upwardly from said foot rest member at said rear edge, said extensions of said abutment stop being adapted to abut against an associated rear face of said front legs, thereby to limit downward pivoting movements of said foot rest member, two brackets, one of which is affixed to the underface of said foot rest member adjacent to one said side edge, the other of which is affixed to the underface of said foot rest member adjacent to the other said side edge, said brackets being at said rear edge, and pin means, which are located forwardly of said rear edge of said foot rest member, thereby connecting each bracket with an associated front leg, thereby to secure said foot rest member to said chair in a cantilevered manner to provide an automatic stop of said upward pivoting to said vertical stowed position, and to permit said pivoting between a positively-stopped horizontal active position and said automatically-stopped stowed position.

2. The chair of claim 1 wherein said abutment stop comprises a bar which is secured to the rear edge of said foot rest and which extends along the entire said rear edge and beyond the two side lateral edges thereof.

3. The chair of claim 1 wherein said foot rest is narrower at its lateral areas than the length of the foot of a typical patient using the chair, and wherein its central portion is even narrower.

4. The chair of claim 3 wherein the width of the foot rest at its lateral areas is about 6" to about 8" and wherein the width of the foot rest at its central areas is correspondingly about 5" to about 7".

5. The chair of claim 1 wherein the height of the seat is about 23" to about 25".

6. The chair of claim 1 wherein said pin means comprises pins which are slidingly-located in an associated one of said brackets said pins being spring-loaded and retractable.

7. The chair of claim 6 wherein said pins are selectively placeable in selected cooperating wells provided as a series of vertically-spaced-apart wells in the front legs for vertically-positioning the foot rest at a desired elevation.

8. The chair of claim 1 including an associated wheel secured in a free-wheeling manner in a bracket which is, in turn, secured to the base of each of the legs, thereby to provide a wheeled patient transporter.

9. The chair of claim 8 wherein said wheel is provided with a mechanically-actuatable brake.

10. A foot rest conversion kit for a chair for invalids and patients said chair including front and rear legs, a seat connecting the legs, said seat including a seating portion having a front edge located at a height above the knees of a typical adult, and a back rest and a foot rest, said foot rest when secured to said chair being pivotable from a substantially-horizontally active position to a substantially-vertical stowed position, said foot rest, when in its vertical stowed position lying entirely within the confines of said legs of said chair, and when in its horizontal active position extending forwardly of said legs of said chair, said foot rest conversion kit comprising: a foot rest member having a front edge, a rear edge, and two side edges which extend between said front edge and said rear edge, said foot rest member being in the form of a relatively narrow platform which is wider at its lateral side edges than at its central area, an abutment stop which is secured directly to the rear edge of said foot rest member, and which coincides with and which lies completely along said rear edge and includes two lateral extensions, one of which extends beyond one said side edge, the other of which extends beyond said other side edge, said abutment stop extending perpendicularly upwardly from said foot rest member, said extensions of said abutment stop being adapted to abut against an associated rear face of said front legs, thereby to limit downward pivoting movements of said foot rest, two brackets, one of which is affixed to the underface of said foot rest member adjacent to one said side edge at said rear edge, the other of which is affixed to the underface of said foot rest member adjacent to the other said side edge at said rear edge, and pin means, which are located forwardly of said rear edge of said foot rest member, for connecting each bracket with an associated front leg, such pin means comprising pins which are slidingly-located in an associated one of said brackets said pins being spring-loaded and retractable, said pins being selectively placeable in selected cooperating wells provided as a series of vertically-spaced-apart wells in the front legs of said chair for vertically-positioning the foot rest at a desired elevation, thereby to secure said foot rest member to said chair in a cantilevered manner to provide an automatic stop of said upward pivoting to said vertical stowed position, and to permit said pivoting between a positively-stopped horizontal active position and an automatically-stopped stowed position.

11. The foot rest of claim 10 wherein an upper face of said foot rest is covered with a non-skid rubber or plastic mat.

12. The chair of claim 10 wherein said abutment stop comprises a bar which is secured to the rear edge of said foot rest and which extends along the entire said rear edge and beyond the two side lateral edges thereof.

13. The chair of claim 10 wherein said foot rest is narrower at its two lateral areas than the length of the foot of a typical patient using the chair, and has a central area which is even less narrower.

14. The chair of claim 13 wherein the width of the foot rest at its lateral areas is about 6" to about 8" and wherein the width of the foot rest at its central area is correspondingly about 5" to about 7".

* * * * *